US006375971B1

(12) United States Patent
Hansen

(10) Patent No.: US 6,375,971 B1
(45) Date of Patent: Apr. 23, 2002

(54) MEDICAMENT DOSING BALLISTIC IMPLANT OF IMPROVED ACCURACY

(75) Inventor: Richard D. Hansen, Urbandale, IA (US)

(73) Assignee: Ballistic Technologies, Inc., Oklahoma City, OK (US)

( * ) Notice: Subject to any disclaimer, the term of this patent is extended or adjusted under 35 U.S.C. 154(b) by 0 days.

(21) Appl. No.: 09/561,224

(22) Filed: Apr. 28, 2000

(51) Int. Cl.[7] ..... A61F 13/00

(52) U.S. Cl. ..... 424/422; 424/423; 424/438; 424/465; 424/484; 424/488; 604/891.1; 514/953

(58) Field of Search ..... 424/422, 408, 424/417, 421, 418, 413, 438, 552, 465, 488, 484; 604/891; 128/260; 514/781, 953

(56) References Cited

U.S. PATENT DOCUMENTS 3,948,263 A 4/1976 Drake, Jr. et al. ..... 128/260
3,982,536 A 9/1976 Krogseng et al. ..... 128/260
4,326,524 A 4/1982 Drake, Jr. et al. ..... 128/260
4,449,982 A * 5/1984 Gould, III ..... 604/891
4,664,664 A * 5/1987 Drake ..... 604/891

OTHER PUBLICATIONS

Crossley et al, Projectile Driving Bands, CAPLUS AN 1971:477852 abs and citation, Jun. 23, 1971.*

* cited by examiner

*Primary Examiner*—Deborah D. Carr
(74) *Attorney, Agent, or Firm*—McKee, Voorhees & Sease, P.L.C.

(57) ABSTRACT

Solid dose ballistic projectile for medicating animals which comprises a biologically compatible projectile casing which defines an interior cavity having a wall with a frictionally engagement enhanced surface. A medicament payload, slightly oversized with respect to the cavity, is forced into the cavity engaging the frictionally-enhanced cavity surface for a tight, secure fit. The bullets are of improved accuracy and can be successfully implanted into the flesh of an animal with greater reliability.

8 Claims, 1 Drawing Sheet

MEDICAMENT DOSING BALLISTIC IMPLANT OF IMPROVED ACCURACY

FIELD OF THE INVENTION

The present invention relates to a ballistic implant for successfully administering solid biologically active medicaments to domesticated livestock such as cattle and hogs, and in wild animals.

BACKGROUND OF THE INVENTION

Solid dose ballistic projectiles shaped for penetrating the epidermal layer of living animal tissue are known. They lodge totally within the tissues of the animal for later release of biologically active medicaments into the animal's tissue. "Solid dose" in this context therefore refers to the fact that the body of the projectile is made entirely of a mixture comprising biologically inert, usually soluble and/or biodegradable materials, encasing a biologically active medicament dose, commonly referred to as "the payload".

Such bullets are used not only for domesticated livestock, but often for inoculating wildlife as well. They are particularly advantageous over administering typical liquid vaccines in that the animals do not have to be captured, thus avoiding the traditional time-consuming and costly necessity of gathering and treating the animals. Such herding also often causes animal stress resulting in weight loss, and even death in some animals.

Since it is well known that inoculations under physiological stress are often less effective than when applied to a relaxed animal, ballistic dose administration (using air guns to implant a medicament dose with a biologically inert bullet) has been developed. For examples of ballistic implants, see U.S. Pat. Nos. 3,948,263; 3,982,536; 4,326,524; 4,449,982; and 4,664,664. All of these have in common the use of a projectile, usually shot from an airgun. It penetrates, say 1–5 centimeters into the animal's muscle tissue, where it begins to be reconstituted with the animal's body fluids, usually disintegrating within a few hours, leaving no lasting tissue damage.

While ballistic implants have achieved some degree of success, due to their overcoming the need for gathering and herding of the animals, they have not achieved the degree of commercial success one might expect. This is so because of certain deficiencies, particularly in accuracy, with the currently-used ballistic implants.

Inaccuracy, that is, failure of the projectile to shoot where the gun is aimed causing "misses", wastes medicament, and therefore increases significantly veterinary medicine expense. Moreover, with poor accuracy there is a risk of bullets hitting the animal in areas where the bullet may cause harm (e.g., head, spine, thorax, chest), or in areas where the bullet will not successfully penetrate muscle tissue, such as forelegs and the like.

It can be seen, therefore, that there is a real and continuing need for the development of a ballistic implant of increased accuracy. Doing so would allow successful implanting of medicament at less expense without active drug waste. This invention has as its objective the fulfillment of this need.

SUMMARY OF THE INVENTION

A solid dose ballistic implant for vaccinating or medicating animals. It comprises a biologically inert tissue compatible bullet which defines an interior cavity having a wall with a frictionally enhanced engagement surface. A cylindrical medicament payload, slightly oversized with respect to the dimensions of the interior cavity, is force fit into the interior cavity, engaging the frictionally-enhanced cavity surface for a tight, secure fit. The resulting ballistic implants are of improved accuracy and can be successfully implanted into the flesh of an animal with greater reliability and less drug waste.

DESCRIPTION OF PREFERRED EMBODIMENT

Figure 1:
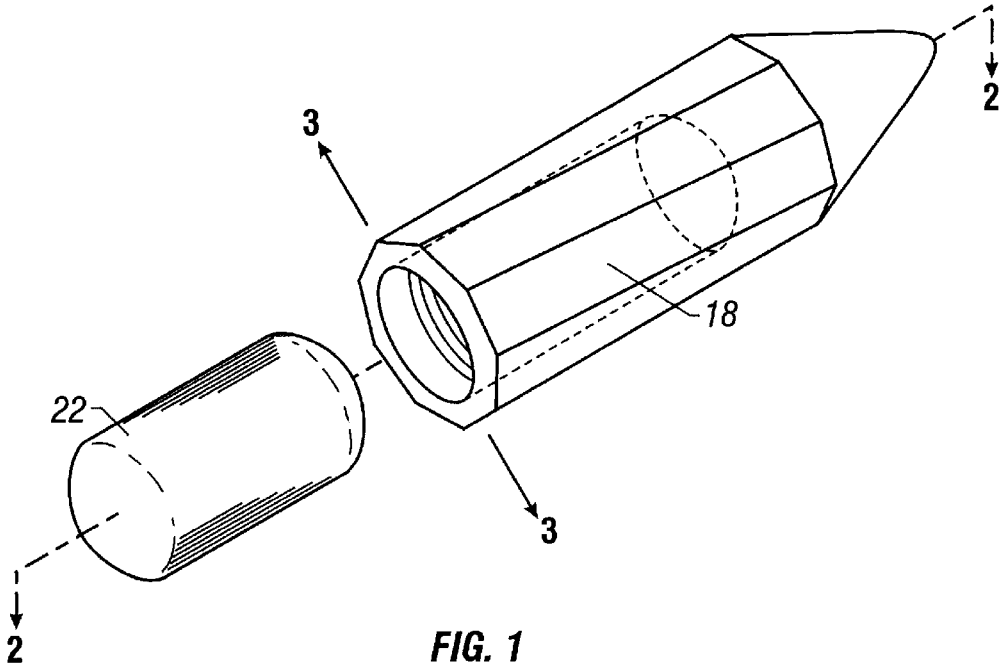
FIG. 1 shows a perspective view of the projectile and the dosing medicament payload.

While the description here is given as a preferred embodiment of the invention, it is to be understood that the invention is not limited to the preferred embodiment only. Rather, the invention is limited only by the defining limits of the claims, as opposed to any statements in this specification relating to the preferred embodiment.

While trying to develop a projectile of increased accuracy, applicant tried several things, all of which one would logically think of as possibilities to increase bullet accuracy. For example, applicant tried form fitting the payload into the cavity, providing a cylindrical payload narrower than the cavity, providing a polymer-sealed narrower payload, providing a rounded back portion of the projectile, as well as different shaped projectile noses. None solved the accuracy problem. Rather, almost by serendipity, applicant discovered that oversized payloads force fit into the cavity of the projectile casing, with the walls of the interior cavity having a surface designed for frictional engagement enhancement, provides for a tight bullet, i.e., the payload and the molded casing move as a single unit, even when shot. This results in target-accurate shots. In particular, and with reference to the drawings, there is shown a cylindrical style projectile 10 having a body portion 12 defining an annular exterior wall 13 with a conical bullet nose or tip 14 terminating at its apex 16. Annular wall 13 defines an interior cavity 18 and a rear or base portion 20. Projectile 10 can be made of any inert material which is capable of being projected with sufficient force to penetrate a living animal body, and maintain its dimensional stability and its integrity on impact and entry of the animal muscle tissue. In order to not cause local tissue reactions, the projectile 10 must be made of biologically inert material. Mostly, such materials should be on the Generally Recognized As Safe, or "GRAS" list. Preferably, projectile 10 should be made of a polymeric blend which will disintegrate after penetrating usually 1–5 centimeters into the animal's muscle tissue. Usually, projectile casings will disintegrate in a few hours, and almost always by 24 hours. A suitable class of GRAS polymers which can be used are cellulose derivatives such as the nonionic water-soluble cellulose ether, hydroxypropylcellulose. Often the casing contains fillers such as calcium carbonate, and a small amount of lubricant such as, for example, stearic acid.

Suitable polymeric binders for inclusion in the mixture are biologically inert materials having characteristics which enable them to impart cohesiveness to the mixture. Preferably, the binder is a thermoplastic material, and the fillers and lubricant thermoplastically stable. Moreover, the binder must be cohesive, that is, it must adhere to other solid particulate ingredients and provide the mixture with a degree of cohesiveness. The binder may have the additional feature of acting as a disintegrant. By proper selection of the binder, the disintegration rate can be controlled to supply the biologically active ingredient in a sustained release or in a quick release manner.

Polymeric binders which have the above-described characteristics, and which enable quick release of the medicament, and are therefore preferred, include such water soluble materials as hydroxypropylcellulose, hydroxypropylmethylcellulose, methylcellulose, sodium carboxymethyl cellulose, polyvinyl alcohol, polyvinyl pyrrolidone, gum arabic, etc. Hydroxypropylcellulose is a particularly preferred binder due to its compatibility with biological systems, its cohesive characteristics, and its thermoplasticity.

Binders which have the required characteristics and are suitable for use in sustained release formulations include such nonpolar-solvent soluble materials as polylactic acids and polyamides, such as polyglycine.

It is to be appreciated that by mixing sustained release and quick release binders, a wide range of dissolution rates can be achieved.

The present invention does not reside so much in the material from which the projectile casing is made, but rather in the particular constructional features of the ballistic implant to provide improved accuracy. While some composition description has been provided, for further details of the bullet formulations, see the earlier-referenced patents, each of which are incorporated herein by reference.

The payload 22 of the ballistic implant is a solid dose medicament. Again, such solid dose medicaments are known, and reference is again made to the above-mentioned patents. However, generally the solid payload may be comprised of adjuvants conventionally employed in preparing tablets by direct compression, such as lubricants, disintegrants, fillers, and of course; the solid medicament. Useful solid particulate biologically active medicaments that may be used in preparations of the present type include hormones, minerals, vitamins, antibiotics, antigens, antibodies, and other medicinals, such as tranquilizers and dewormers.

Figure 2:
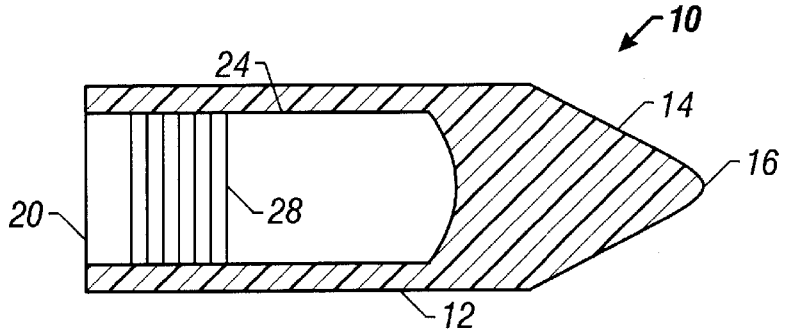
FIG. 2 is a longitudinal section along line 2—2 of FIG. 1 showing the construction of the projectile and its interior cavity.
Figure 3:
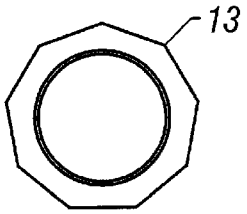
FIG. 3 is a rear end view of the projectile with the interior cavity loaded with medicament payload.
Figure 4:
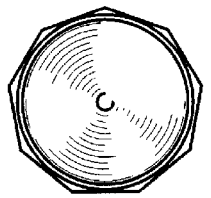
FIG. 4 is a front end view of the projectile.

With reference to FIG. 2, the interior wall 24 of cavity 18 can be seen. As illustrated, interior wall 24 has a series of parallel annular puller rings. Puller rings are concentric parallel ridges 28 which can be made by the core pins and dies used in making the projectile casing, usually by an injection molding or casting process. While annular ridges 28 of puller rings are shown, in fact, any means of raising projections for frictional engagement enhancement of the inner wall 24 surface of the interior cavity 18 can be utilized. Conceivably, any non-smooth discontinuity, in the form of which provide a frictionally engagement enhancing surface, would suffice. Examples might include ridges, bumps, nodules, grooves, etc.

Certain constructional features may be worthwhile to mention specifically. Typically, for ballistic implanting, applicant has found a standard 25 caliber bullet suitable. Length of the bullet doesn't appear critical. Bullets of 0.577 inches, 0.658 inches and 0.825 inches all seem to work, with longer bullets providing best accuracy. Preferred dimensions are the following: ID=0.160" (+0.003",–0.000"); OD (flat to flat)=0.2535"±0.001"; OD (spine to spine)=0.2635"±0.001"; Core depth: 0.260"; 1 in 7 or 1 in 6 twist.

Back, or base 20 of the ballistic implant is typically either flush, or more preferably, concave for enhanced accuracy.

The payload 22 is force fit into cavity 18 from the back 20. For example, on the illustrated bullet 10, assume the ID is 0.160". Critical to force fitting the payload 22, is that it be slightly oversized. For example, a high degree of success and accuracy was achieved if one used payloads of 0.163" diameter. These pellet payloads insert readily when uniformly forced, and fit snugly without expanding the OD of the bullet. They fit snugly without any slop because they are force fit, and because they are compressed against frictionally engagement enhanced surfaces of puller rings such as by ridges 28.

Surprisingly, when these force fit ballistic implants hereinafter are shot, increased accuracy and increased range are achieved. Moreover, various length bullets can be used, as earlier explained, and payloads having a weight of from 90 mg to 150 mg or more can be successfully used with the 25 caliber bullet without varying the accuracy.

EXAMPLE

The following example is offered to illustrate accuracy of the new bullets using the frictional engagement enhanced interior cavity surface as opposed to bullets of compatible, lesser diameter payload.

In particular, a crimped-back bullet casing containing a placebo of lesser diameter (0.156") than the ID (0.160") of the cavity was used for a series of shots at paper targets. The caliber was 25. In comparison, when identical 25 caliber bullet casings were used in the present invention, the shot grouping was far narrower, and less random, indicating higher accuracy. Table I shows the results.

TABLE I

ACCURACY COMPARISON

| Pellet Diameter | Shot Grouping* (n = 5) |
|---|---|
| 0.156" | 10.5 cm |
| 0.163" | 4.0 cm |

*Farthest distance apart

NOTE

Ballistic device "fixed" in a vise at a distance of 20' from the target for this experiment.

It therefore can be seen that the invention accomplishes at least all of its stated objectives.

What is claimed is:

1. A ballistic implant for solid dose medicating of animals, comprising:

a biologically compatible bullet having a bullet nose and a bullet body, said bullet body defining a cavity having an interior wall;

said interior wall having a raised frictional engagement enhancing surface; and a medicament payload contained with said cavity in secure engaging relationship with said interior wall.

2. The ballistic implant of claim 1 wherein the raised frictional engagement enhancing surface of said interior wall is a wall surface having a non-smooth discontinuity.

3. The ballistic implant of claim 2 wherein the non-smooth discontinuity is a series of parallel annular ridges.

4. The ballistic implant of claim 3 wherein the parallel annular ridges are puller rings formed by a bullet forming core pin and die.

5. The ballistic implant of claim 1 which is 25 caliber.

6. The ballistic implant of claim 1 wherein the bullet is formed of a soluble cellulose derivative.

7. The ballistic implant of claim 1 wherein the medicament payload is a particulate, active medicament.

8. The ballistic implant of claim 7 wherein the medicament payload is selected from the group consisting of hormones, minerals, vitamins, antibiotics, antigens, antibodies, tranquilizers and dewormers.

* * * * *